US006814003B2

(12) United States Patent
Tobe et al.

(10) Patent No.: US 6,814,003 B2
(45) Date of Patent: Nov. 9, 2004

(54) PLATE HANDLING METHOD AND APPARATUS FOR PRINTING PRESS

(75) Inventors: Kenji Tobe, Higashikatsushika-gun (JP); Kazunori Takeda, Higashikatsushika (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 10/400,552

(22) Filed: Mar. 28, 2003

(65) Prior Publication Data

US 2003/0183108 A1 Oct. 2, 2003

(51) Int. Cl.[7] ..... B41F 13/008; B41F 5/000
(52) U.S. Cl. ..... 101/477; 101/484; 101/247
(58) Field of Search ..... 101/247, 477, 101/479, 480, 484, 483, 216

(56) References Cited

U.S. PATENT DOCUMENTS 5,983,793 A * 11/1999 Volz et al. ..... 101/216
6,598,528 B2 * 7/2003 Nakano et al. ..... 101/484

FOREIGN PATENT DOCUMENTS

JP 59-042957 * 3/1984
JP 3-286865 12/1991
JP 2704558 B2 10/1997
JP 11-170486 A 6/1999

* cited by examiner

*Primary Examiner*—Leslie J. Evanisko
(74) *Attorney, Agent, or Firm*—Birch, Stewart, Kolasch & Birch, LLP

(57) ABSTRACT

A plate handling method and apparatus for a printing press that includes printing units, each having a plate cylinder, a main unit motor for driving the plate cylinders, and electromagnetic clutches disposed between the main unit motor and the printing units for transmitting and cutting off a drive force from the main unit motor to the printing units, and is adapted to rotate the plate cylinders upon the drive by the main unit motor and change plates. The electromagnetic clutch of the printing unit is disengaged, when an abnormality in changing of the plate was detected by any of sensors provided in each printing unit for detecting an abnormality in plate changing, to cut off the drive by the main unit motor, but continue plate changing in the other printing units by the drive force from the main unit motor.

6 Claims, 6 Drawing Sheets

PLATE HANDLING METHOD AND APPARATUS FOR PRINTING PRESS

CROSS-REFERENCE TO RELATED APPLICATION

The entire disclosure of Japanese Patent Application No. 2002-90987 filed on Mar. 28, 2002, including specification, claims, drawings and summary, is incorporated herein by reference in its entirety.

BACKGROUND OF THE INVENTION

1. Field of the Invention

This invention relates to a plate handling method and a plate handling apparatus for a plate cylinder of a printing press.

2. Description of the Related Art

For a web rotary press or the like, in which a plurality of printing units are arranged, various proposals have been made for an automatic plate changer, which automatically mounts a printing plate (hereinafter referred to simply as a plate) at a predetermined position of a plate cylinder of each of the plural printing units, and automatically removes the plate from the plate cylinder.

For example, Japanese Patent No. 2704558 discloses a method for changing plates in a printing press having a plurality of printing units different in the rotation phase of each plate cylinder, whereby even when plate removal in one of the printing units is taking place, a plate removal operation is performed in the other printing units, thus shortening the plate changing time.

If an error occurs during the plate removal (or plate supply) operation by the automatic plate changer, the plate being removed may be caught by ink form rollers and damage a blanket or the roller, unless the plate changing procedure is promptly stopped.

Thus, Japanese Unexamined Patent Publication No. 1999-170486 discloses a feature in which a sensor is provided for detecting an abnormality in the plate being removed during the plate removal, and when the abnormality in the plate removal is detected by the sensor, a printing press is shut down.

In the plate changing method disclosed in Japanese Patent No. 2704558, however, the rotation phase of the plate cylinder is different among the printing units, as stated above. Therefore, in the printing units showing no abnormality in the plate removal at the time when an abnormality in the plate removal was detected in the other printing unit, the plate may be removed with its end portion being detached from the plate cylinder, or the plate remains substantially unremoved with its end portion being held by the plate cylinder.

If, in this state, the plate cylinder is rotated in a normal or reverse direction to remove the plate of the printing unit showing the abnormality in the plate removal, the plate cylinders of all printing units are rotated in the normal or reverse direction in an interlocked manner. Thus, damage may be caused to the printing plate of other printing unit where no abnormality in the plate removal was detected when the abnormality was detected. To remove the damaged printing plate, many man-hours and much time are required. Similar problems are posed when an abnormality in the plate being supplied occurs during a plate supply operation for automatically mounting printing plates on plate cylinders.

SUMMARY OF THE INVENTION

The present invention has been conceived to solve the above problems. Its object is to provide a plate handling method and a plate handling apparatus for a printing press having a plurality of printing units, the method and the apparatus being constituted such that during a plate removal or plate supply operation for the erring unit where an abnormality in the plate removal or plate supply was detected, a plate removal or supply operation for the other normal units can be performed continuously, whereby the plate removal or supply can be carried out reliably in a short period of time.

To attain the above object, there is provided, according to an aspect of the present invention, a plate handling method of a printing press having plate handling apparatuses, the printing press having a plurality of printing units, each printing unit having a plate cylinder, a drive device for driving all of the plate cylinders, and clutches disposed between the drive device and the printing units for transmitting and cutting off a drive force from the drive device to the printing units, and the printing press being adapted to rotate the plate cylinders by the drive from the drive device and cause the plate handling apparatuses to insert plates into the plate cylinders or remove the plates from the plate cylinders, the plate handling method comprising:

disengaging the clutch of the printing unit, where an abnormality in supply or removal of the plate was detected by any of detectors provided in the each printing unit for detecting the abnormality in supply or removal of the plate, to cut off the drive force from the drive device;

and allowing the drive force from the drive device to remain transmitted in the other printing units, thereby continuing supply or removal of the plates in the other printing units.

In the plate handling method of the printing press, the plate handling apparatus may comprise an actuator for driving a moving plate guide, a plate dismounting actuator for driving a plate dismounting guide, and a plate press roller actuator for driving a plate press roller, and may inhibit the three actuators from acting in case of the abnormality in supply or removal of the plate.

In the plate handling method of the printing press, an alarm may be issued by a warning device in the printing unit where the abnormality in supply or removal of the plate was detected.

According to another aspect of the present invention, there is provided a plate handling apparatus of a printing press, the printing press having a plurality of printing units, each printing unit having a plate cylinder, a drive device for driving all of the plate cylinders, and clutches disposed between the drive device and the printing sections for transmitting and cutting off a drive from the drive device to the printing units, the plate handling apparatus comprising: detectors provided in the each printing unit for detecting an abnormality in supply or removal of the plate; and a control device for disengaging the clutch of the printing unit, where the abnormality in supply or removal of the plate was detected by any of the detectors, to cut off the drive by the drive device, and allowing drive force from the drive device to remain transmitted in the other printing units, thereby continuing supply or removal of the plates in the other printing units.

The plate handling apparatus of the printing press may comprise an actuator for driving a moving plate guide, a plate dismounting actuator for driving a plate dismounting guide, and a plate press roller actuator for driving a plate press roller, and the control device may inhibit the three actuators from acting in case of the abnormality in supply or removal of the plate.

The plate handling apparatus of the printing press may include a warning device in each of the printing units, and the control device may exercise control such that if the abnormality in supply or removal of the plate is detected by any of the detectors, the warning device in the printing unit concerned issues an alarm.

According to the plate handling method and apparatus of the present invention, the drive force from the drive device to the printing unit, where an error (abnormality) during plate changing has occurred, is cut off, but a plate changing operation for the other printing units is continued. Thus, the plate changing time can be shortened, and damage to the plate, plate cylinder, and surrounding devices in the printing unit undergoing the error can be minimized.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTIONS

A plate handling method and apparatus of a printing press according to the present invention will now be described in detail by an embodiment with reference to the accompanying drawings, which in no way limit the invention.

Embodiment

Figure 1:
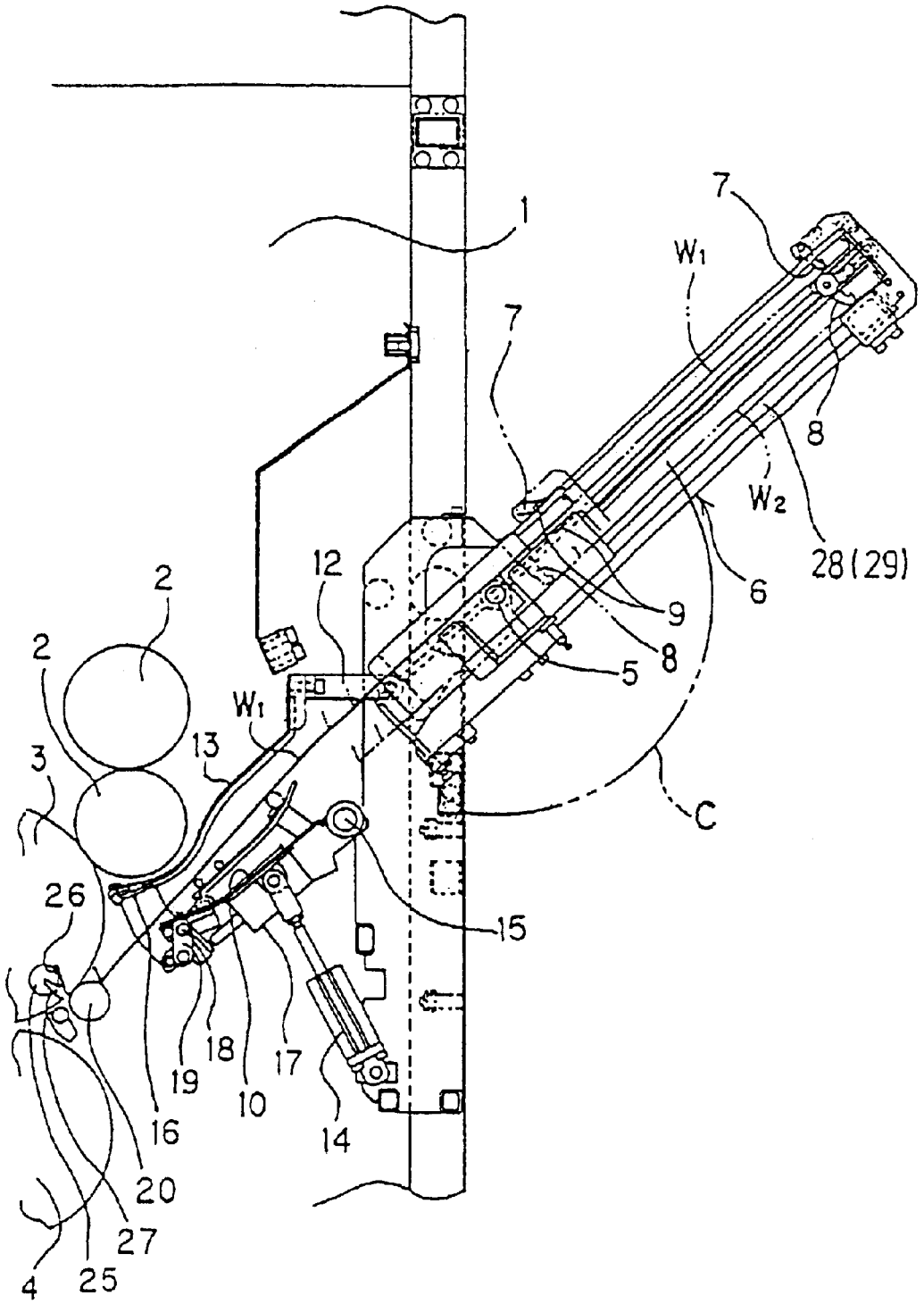
FIG. 1 is a schematic configuration drawing of an automatic plate changer and its surroundings showing an embodiment of the present invention.
Figure 2:
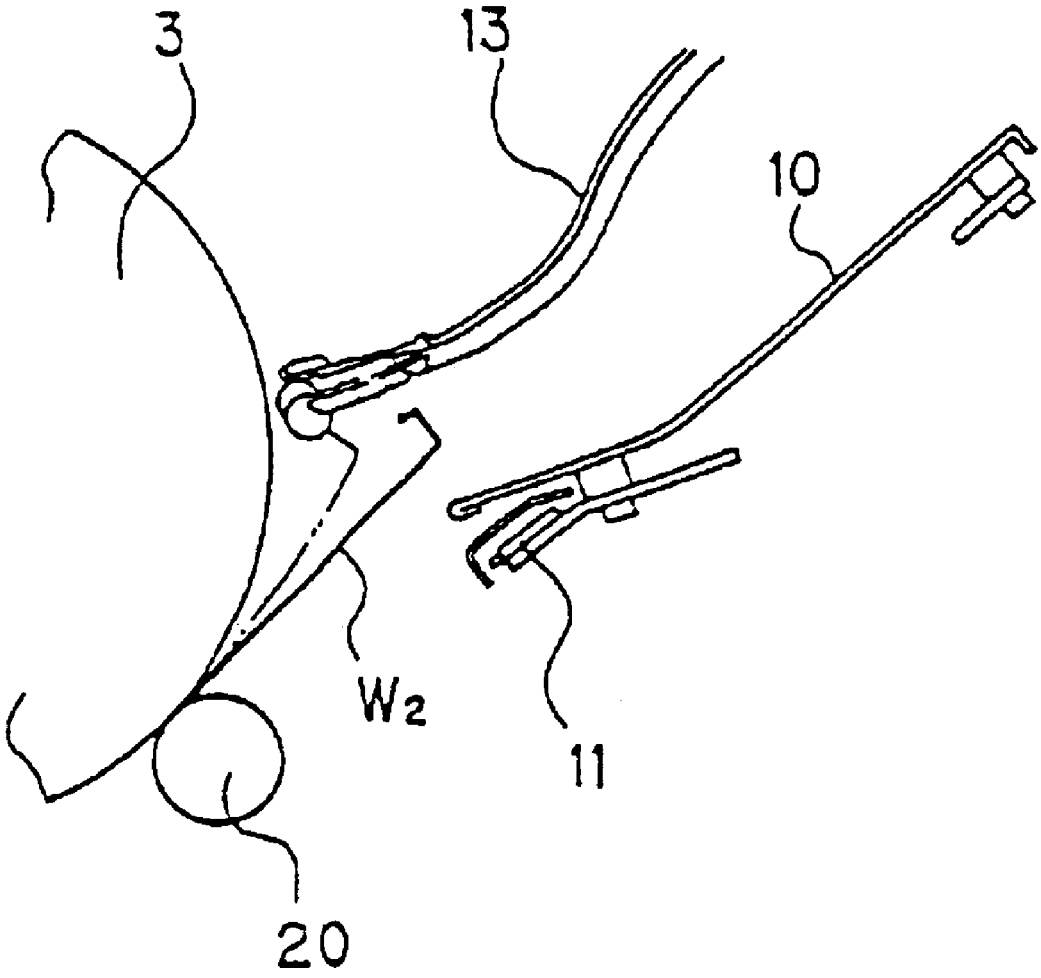
FIG. 2 is an enlarged view of a moving plate guide portion.
Figure 3:
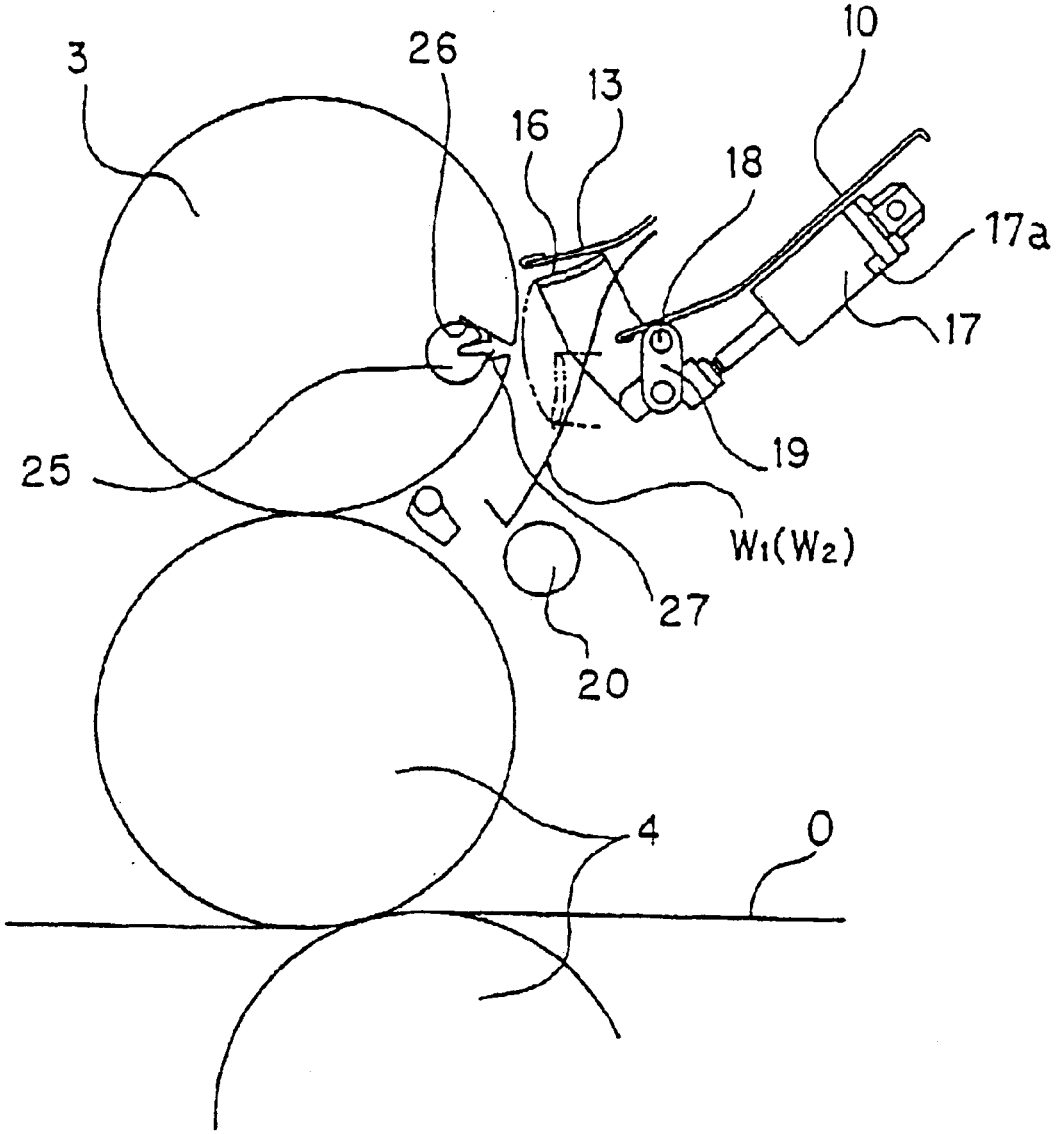
FIG. 3 is an enlarged view of a plate gripping/extracting guide portion.
Figure 4:
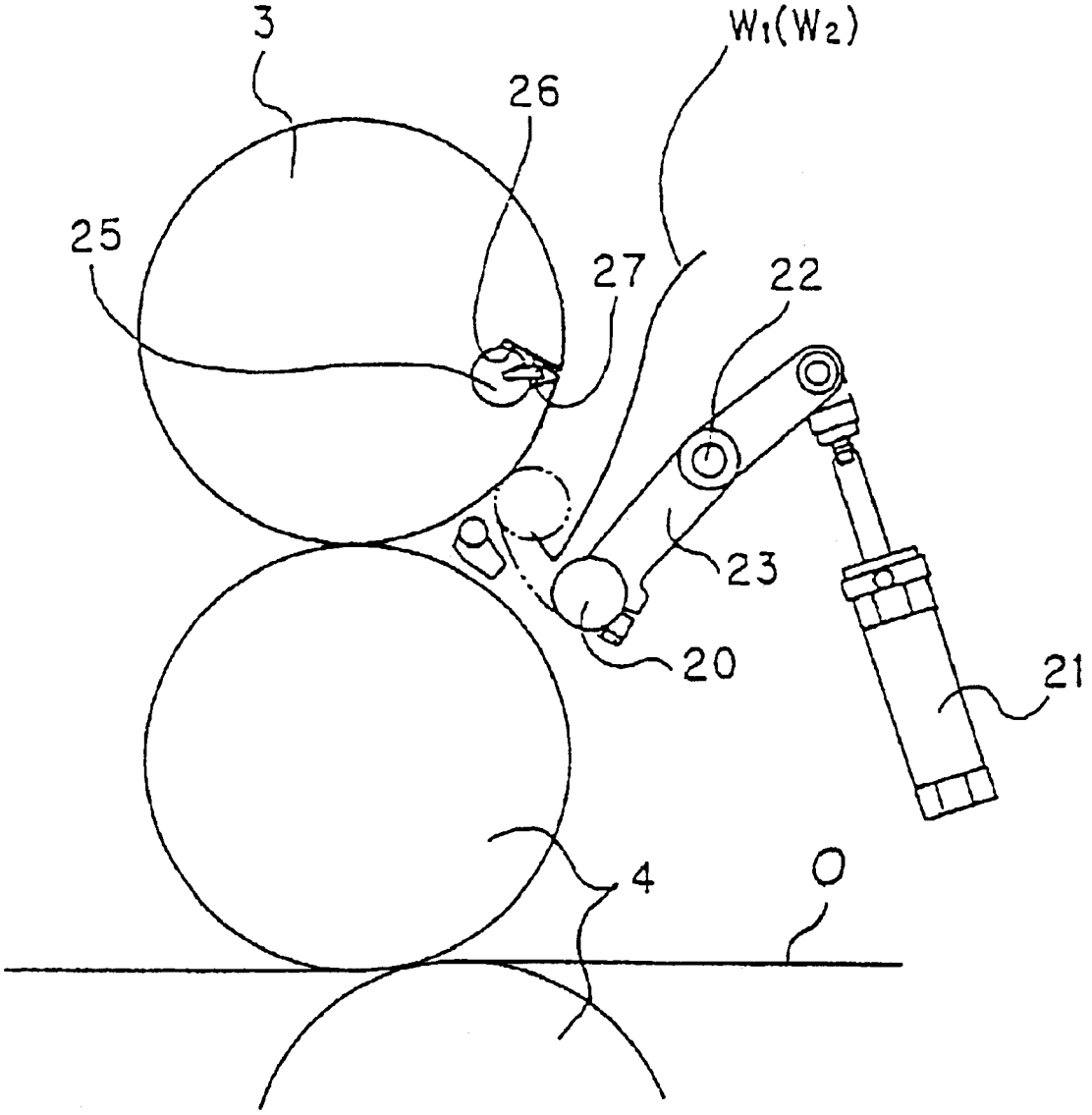
FIG. 4 is an enlarged view of a plate press roller portion.
Figure 5:
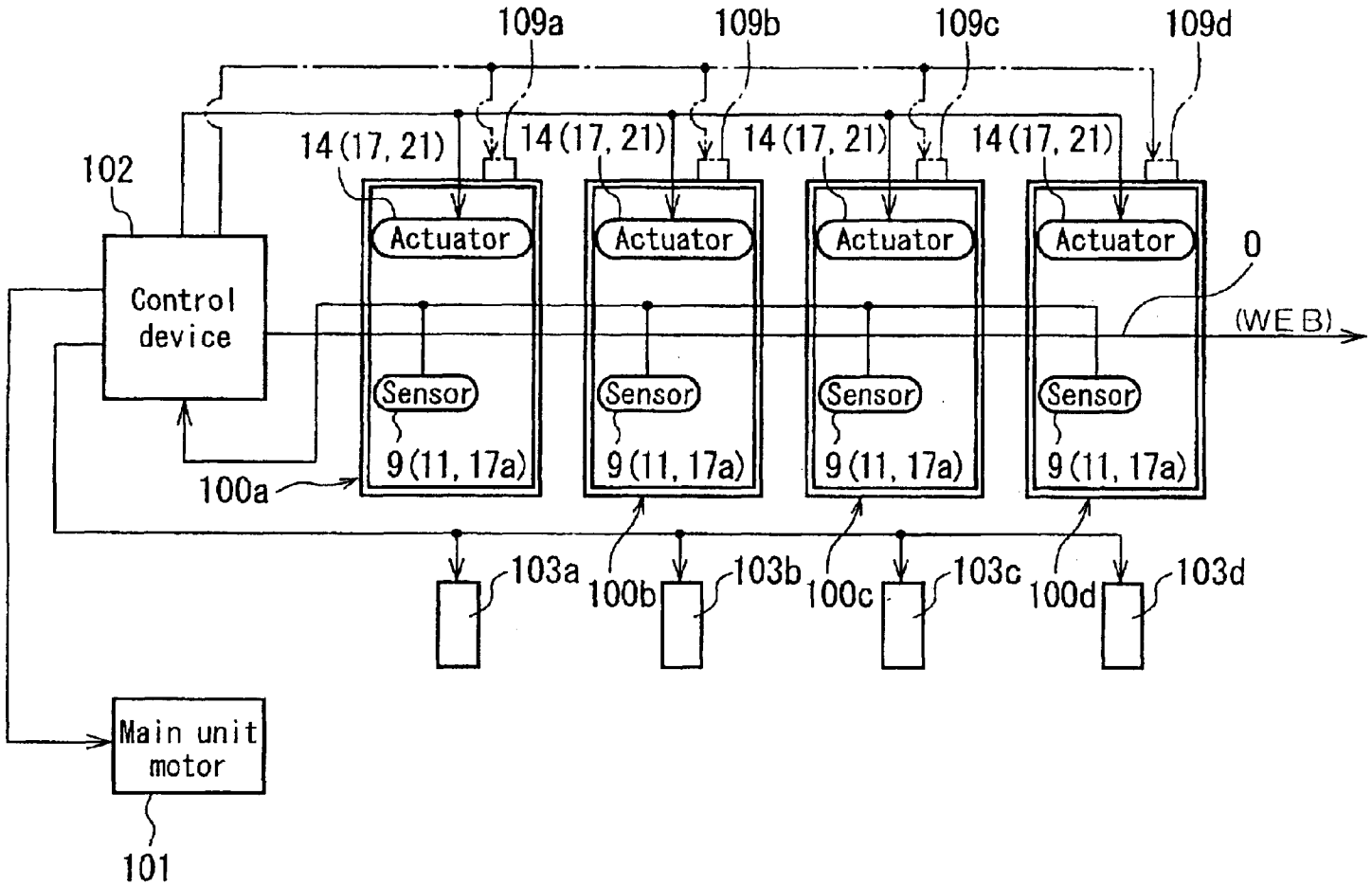
FIG. 5 is a schematic block diagram of an entire perfecting printing press.
Figure 6:
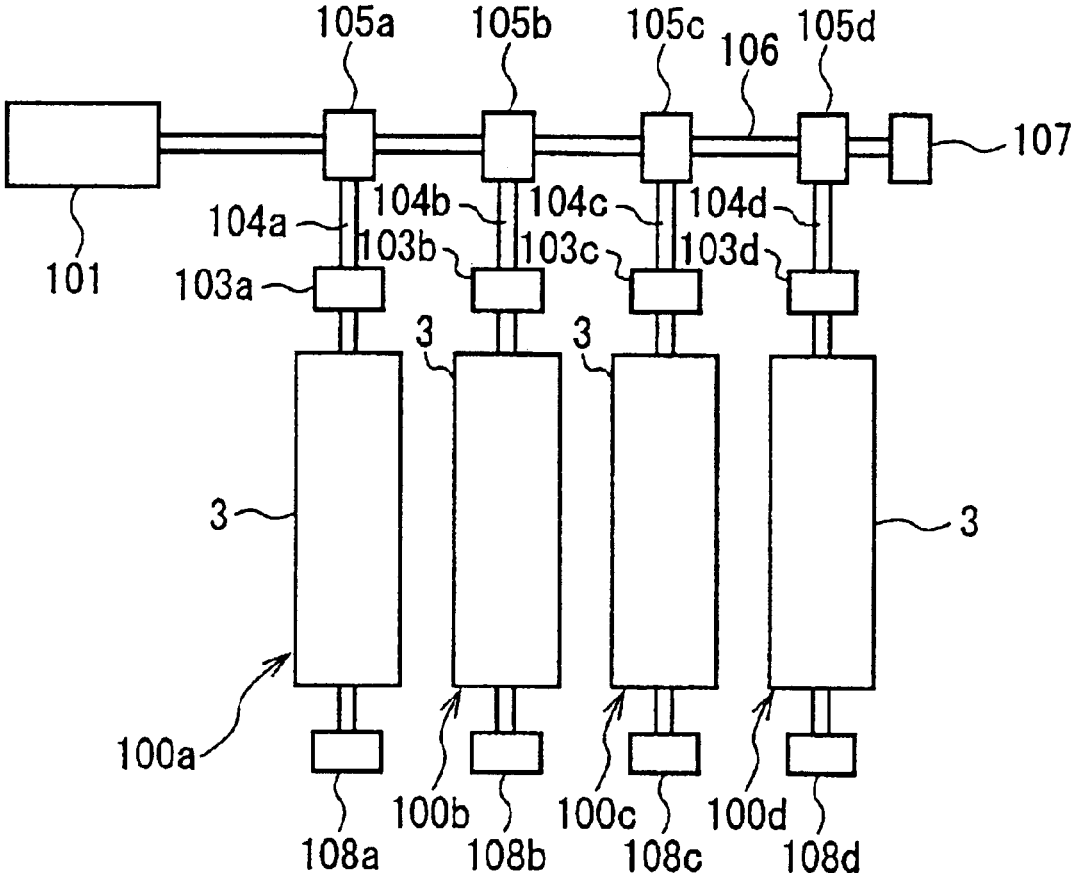
FIG. 6 is a schematic configuration drawing of a drive system.

FIG. 1 is a schematic configuration drawing of an automatic plate changer and its surroundings showing an embodiment of the present invention. FIG. 2 is an enlarged view of a moving plate guide portion. FIG. 3 is an enlarged view of a plate gripping/extracting guide portion. FIG. 4 is an enlarged view of a plate press roller portion. FIG. 5 is a schematic block diagram of an entire perfecting printing press. FIG. 6 is a schematic configuration drawing of a drive system.

As shown in FIG. 1, ink rollers 2, a plate cylinder 3, and a blanket cylinder 4 of an upper printing section (upper printing unit) are rotatably supported between right and left frames 1 of a perfecting printing press, and a web O (as shown in FIG. 4) passing between the blanket cylinder 4 and a blanket cylinder 4 of a lower printing section (lower printing unit) is subjected to printing. The upper printing unit and the lower printing unit constitute a set, and a plurality of the sets are arranged in line in the direction of travel of the web O, although these features are not shown. These cylinders are rotated in an interlocked manner by a drive device (to be described later) via a power transmission mechanism.

An automatic plate changer is provided for each of the upper printing unit and the lower printing unit of each of the sets mentioned above. The automatic plate changers in the upper printing unit and the lower printing unit are of nearly the same basic construction, and disposed symmetrically in a vertical direction with respect to each other. Moreover, various constructions can be applied for them. Thus, only the automatic plate changer of the upper printing unit will be taken as an example, and explained briefly.

A loader 6 is rotatably supported between the right and left frames 1 about a pivot shaft 5 (see the locus of rotation, C, in the drawing). Within the loader 6, a new plate $W_1$ and a removal plate (a plate to be removed) $W_2$ are to be gripped by a new plate hooking member 7 and a removal plate hooking member 8, respectively.

For a plate supply, the loader 6 is rotated counterclockwise to the illustrated state by an actuator (not shown). Then, the new plate hooking mechanism 7, with which the trailing edge of the new plate $W_1$ is engaged, is moved obliquely and downwardly from an ascent limit by a new plate moving actuator 28, such as a rodless cylinder, whereby the new plate $W_1$ is supplied to the plate cylinder 3. The state of new plate insertion at this time is detected by a transmission type plate supply sensor (detector) 9 provided in the loader 6 near a descent limit of the new plate hooking member 7. That is, if the plate supply sensor 9 remains shut off without passage of the trailing edge of the new plate $W_1$ through the plate supply sensor 9 at a predetermined time, it is determined that an abnormality in plate supply has occurred.

For plate a removal, with the loader 6 located at the same position as mentioned above, the removal plate hooking member 8, with which the trailing edge of the removal plate $W_2$ is engaged, is moved obliquely and upwardly from the descent limit by a removal plate accommodating actuator 29, such as a rodless cylinder, whereby the removal plate $W_2$ is accommodated into the loader 6. The state of plate removal at this time is detected by a reflection type plate tail sensor(detector) 11 provided at the front end of a moving plate guide 10, as shown in FIG. 2. That is, if, at a predetermined time, the tail or trailing edge of the removal plate $W_2$ does not pass beside the plate tail sensor 11 and the plate tail sensor 11 is not shut off, it is determined that an abnormality in plate removal has occurred.

Between the right and left frames 1, a stationary plate guide 13 is provided via a bracket 12, and the aforementioned moving plate guide 10 is supported to be swingable between an advance position and a retreat position about a pivot shaft 15 by an actuator 14, such as an air cylinder. A plate dismounting guide 16 is supported by the moving plate guide 10 to be swingable between an advance position and a retreat position about a pivot shaft 18 by a plate dismounting actuator 17, such as an air cylinder, via a lever 19, as shown in FIG. 3. The removal/holding position (see a two-dot chain line in FIG. 3) of the plate dismounting guide 16 is detected by a dismounting sensor (detector) 17*a*, such as a position sensor, as the maximum contraction position of the plate dismounting actuator 17, whereby it is detected, as by the plate tail sensor 11, whether there is an abnormality in the state of plate removal.

Between the right and left frames 1 and below the moving plate guide 10, a plate press roller 20 is supported to be swingable between an advance position (see a two-dot chain line in FIG. 4) and a retreat position about a pivot shaft 22 by a plate press roller actuator 21, such as an air cylinder, via a bell crank 23, as shown in FIG. 4. In FIGS. 1, 3, and 4, the numeral 25 denotes a winding bar rotatably fitted within a gap 26 of the plate cylinder 3.

The various actuators 14, 17, and 21 are driven and controlled by a control device (CPU) 102, such as a microcomputer, which also controls a main unit motor 101 as the aforementioned drive device for imparting interlocked rotations to all of the plate cylinders 3 of four printing units 100*a* to 100*d*, each having the upper printing unit and the lower printing unit, as shown in FIG. 5.

Detection signals from the aforementioned various sensors 9, 11, and 17*a* are inputted into the control device 102, while control signals from the control device 102 are outputted to electromagnetic clutches 103*a* to 103*d* (to be described later) of the four printing units 100*a* to 100*d*, as well as to the various actuators 14, 17, and 21.

The electromagnetic clutches 103*a* to 103*d* are fitted around unit shafts 104*a* to 104*d* of the printing units 100*a* to 100*d*, and these unit shafts 104*a* to 104*d* are connected to a single line shaft 106, which is rotated by the main unit motor 101, via transmission mechanisms 105*a* to 105*d*, as shown in FIG. 6.

Thus, the printing units 100*a* to 100*d* can select the switch-on and switch-off of transmission of the drive force of the main unit motor 101 to the units upon engagement and disengagement of the electromagnetic clutches 103*a* to 103*d* that the printing units 100*a* to 100*d* possess. A rotary encoder 107 is connected to the line shaft 106 to detect the phase of the line shaft 106, and rotary encoders 108*a* to 108*d* are connected to the plate cylinders 3 so as to detect the phases of the respective plate cylinders 3.

The control device 102 disengages the electromagnetic clutch 103*a*, 103*b*, 103*c* or 103*d* of the printing section, where an abnormality in the plate changing is detected by the sensor 9, 11 or 17*a*, to cut off driving by the main unit motor 101, and keeps the electromagnetic clutch 103*a*, 103*b*, 103*c* or 103*d* engaged in the other printing section to continue the plate changing by driving by the main unit motor 101.

Because of these features, a plate changing operation by the automatic plate changer is performed, for example, by a human operation of a plate changing button, whereby the main unit motor 101 is driven and the actuators 14, 17, and 21 are sequentially actuated via the control device 102.

If an abnormality occurs in the printing section of the given printing unit 100*a*, 100*b*, 100*c* or 100*d* during a plate removal or supply operation for each printing section, this abnormality is detected by the sensor 9, 11 or 17*a*, and a detection signal therefrom is inputted into the control device 102.

When receiving the detection signal, the control device 102 exercises control in such a manner as to disengage the electromagnetic clutch 103*a*, 103*b*, 103*c* or 103*d* of the printing section, where the abnormality occurred, to cut off the drive force from the main unit motor 101 to the printing section in question, thereby stopping the rotation of the plate cylinder 3 in the direction of plate removal or plate winding, and inhibiting the action of the various actuators 14, 17, and 21 of the plate changer which underwent the abnormality. On the other hand, the normal printing section has the electromagnetic clutch 103*a*, 103*b*, 103*c* or 103*d* kept engaged, so that the plate removal operation or the plate supply operation for the respective printing sections by the automatic plate changers is continued. After this plate changing operation is brought to a halt, the electromagnetic clutch 103*a*, 103*b*, 103*c* or 103*d* of the printing unit 100*a*, 100*b*, 100*c* or 100*d*, where the electromagnetic clutch 103*a*, 103*b*, 103*c* or 103*d* is in disengagement, is engaged, and a plate changing operation for the printing unit 100*a*, 100*b*, 100*c* or 100*d* in question is performed by an operator.

Accordingly, the plate changing for the normal printing sections can be completed without the need to wait for completion of a restoring operation for the abnormal printing section. As a result, the working time for the entire plate changing procedure can be shortened.

In the foregoing embodiment, moreover, the respective printing units 100*a* to 100*d* may be provided with warning devices 109*a* to 109*d* (see FIG. 5). The control device 102 may be adapted to exercise control such that if the sensor 9, 11 or 17*a* detects an abnormality in the supply or removal of the plate, the warning device 109*a*, 109*b*, 109*c* or 109*d* of the printing unit 100*a*, 100*b*, 100*c* or 100*d* concerned issues an alarm.

While the present invention has been described in conjunction with the above embodiment, it is to be understood that the invention is not limited thereby, but may be varied or modified in many other ways. For example, mechanical clutches using actuators or the like may be employed instead of the electromagnetic clutches. Moreover, if a failure in the plate changing occurs, the clutch concerned is automatically disengaged. However, the operator may be informed of the failure in the plate changing by a lamp or the alarm, so that the operator can operate a push-button or the like to manually disengage the clutch of the unit concerned. Furthermore, in the present embodiment, the sensor detects an abnormality in the plate removal or plate supply during a plate removal or supply operation by the automatic plate changer, thereby automatically disengaging the electromagnetic clutch concerned. However, there may be a feature in which the abnormality in the plate removal or supply is detected by the sensor, then the machine is stopped once, the electromagnetic clutch concerned is disengaged by a push-button or the like, and then the plate changing operation is restored. The plate changing may be performed either in the order of arrangement of the units, or starting with the units having the plate cylinders similar in the plate changing phase. Besides, the above-described embodiment discloses an example in which the present invention is applied to a plate changer for performing the supply and removal of the plate. However, the same effects may be obtained even when the present invention is used for a plate feeder (a device having only the function of supplying a plate), or for a plate remover (a device having only the function of removing a plate). Such variations or modifications are not to be regarded as a departure from the spirit and scope of the invention, and all such variations and modifications as would be obvious to one skilled in the art are intended to be included within the scope of the appended claims.

What is claimed is:

1. A plate handling method of a printing press having plate handling apparatuses, said printing press having a plurality of printing units, each printing unit having a plate cylinder, a drive device for driving all of said plate cylinders, and clutches disposed between said drive device and said printing units for transmitting and cutting off a drive force from said drive device to said printing units, and said printing press being adapted to rotate said plate cylinders upon said drive by said drive device and cause said plate handling apparatuses to insert plates into said plate cylinders or remove plates from said plate cylinders, comprising:

disengaging said clutch of said printing unit, where an abnormality in supply of said plate or removal of said plate has been detected by any of detectors provided in each said printing unit for detecting said abnormality in supply of said plate or removal of said plate, to cut off said drive by said drive device; and allowing the drive force by said drive device to remain transmitted in the other printing units, thereby continuing supply of said plates or removal of said plates in the other printing units.

2. The plate handling method of the printing press according to claim 1, wherein said plate handling apparatus includes an actuator for driving a moving plate guide, a plate dismounting actuator for driving a plate dismounting guide, and a plate press roller actuator for driving a plate press roller, and inhibits each actuator from acting in case of said abnormality in supply of said plate or removal of said plate.

3. The plate handling method of the printing press according to claim 1, wherein an alarm is issued by a warning device in said printing unit where said abnormality in supply of said plate or removal of said plate was detected.

4. A plate handling apparatus of a printing press, said printing press including a plurality of printing units each having a plate cylinder, a drive device for driving all of said plate cylinders, and clutches disposed between said drive device and said printing units for transmitting and cutting off a drive force from said drive device to said printing units, comprising:

detectors provided in each said printing unit for detecting an abnormality in supply of a plate or removal of a plate; and a control device for disengaging said clutch of said printing unit, where said abnormality in supply of said plate or removal of said plate was detected by any of said detectors, to cut off said drive by said drive device, and allowing said drive by said drive device to remain transmitted in the other printing units, thereby continuing supply of said plates or removal of said plates in the other printing units.

5. The plate handling apparatus of the printing press according to claim 4, further comprising:

an actuator for driving a moving plate guide;

a plate dismounting actuator for driving a plate dismounting guide; and a plate press roller actuator for driving a plate press roller, wherein said control device inhibits said three actuators from acting in case of said abnormality in supply of said plate or removal of said plate.

6. The plate handling apparatus of the printing press according to claim 4, further comprising:

a warning device in each of said printing units, wherein said control device exercises control such that if said abnormality in supply of said plate or removal of said plate is detected by any of said detectors, said warning device in said printing unit concerned issues an alarm.

* * * * *

UNITED STATES PATENT AND TRADEMARK OFFICE

CERTIFICATE OF CORRECTION

PATENT NO. : 6,814,003 B2
APPLICATION NO. : 10/400552
DATED : November 9, 2004
INVENTOR(S) : Kenji Tobe et al.

It is certified that error appears in the above-identified patent and that said Letters Patent is hereby corrected as shown below:

Please insert the following information On the title page:

item [30] Foreign Application Priority Data

Mar. 28, 2002 [JP] Japan .....2002-90987

Signed and Sealed this

Twenty-fourth Day of June, 2008

JON W. DUDAS
*Director of the United States Patent and Trademark Office*